US005802908A

United States Patent [19]

Frenken

[11] Patent Number: 5,802,908

[45] Date of Patent: Sep. 8, 1998

[54] PRESS TOOL

[75] Inventor: Egbert Frenken, Heinsberg, Germany

[73] Assignee: Gustav Klauke GmbH, Remscheid, Germany

[21] Appl. No.: 892,687

[22] Filed: Jul. 14, 1997

[30] Foreign Application Priority Data

Jul. 17, 1996 [DE] Germany ..... 196 28 752.9

[51] Int. Cl.[6] ..... H01R 43/042

[52] U.S. Cl. ..... 72/409.16; 72/413; 72/473; 29/751

[58] Field of Search ..... 72/409.16, 409.14, 72/413, 416, 473; 29/751; 81/422

[56] References Cited

U.S. PATENT DOCUMENTS

| | | | |
|---|---|---|---|
| 1,300,324 | 4/1919 | Amos | 72/414 |
| 2,900,854 | 8/1959 | Werner | 72/409.16 |
| 3,397,567 | 8/1968 | Klinger . | |
| 4,825,682 | 5/1989 | Orav | 72/416 |
| 5,301,532 | 4/1994 | Bickmore | 72/413 |

FOREIGN PATENT DOCUMENTS

| | | |
|---|---|---|
| 2841588 | 3/1980 | Germany . |
| 3617834 | 12/1987 | Germany . |

*Primary Examiner*—Daniel C. Crane
*Attorney, Agent, or Firm*—Martin A. Farber

[57] ABSTRACT

A press tool (1) for pressing cable terminals and connectors or the like onto electrical conductors, having two clamping jaws (2, 3) movable against one another, there being rotatably mounted in each clamping jaw (2, 3), respectively one disc-type press die (27, 29) formed with several different press troughs (33, 34) on the circumference, which press die is lockable in each working position. A second press die (28, 30) is associated with each press die (27, 29), the second press die being arranged to be rotatable independently of the first press die (27, 29).

10 Claims, 4 Drawing Sheets

Fig. 2
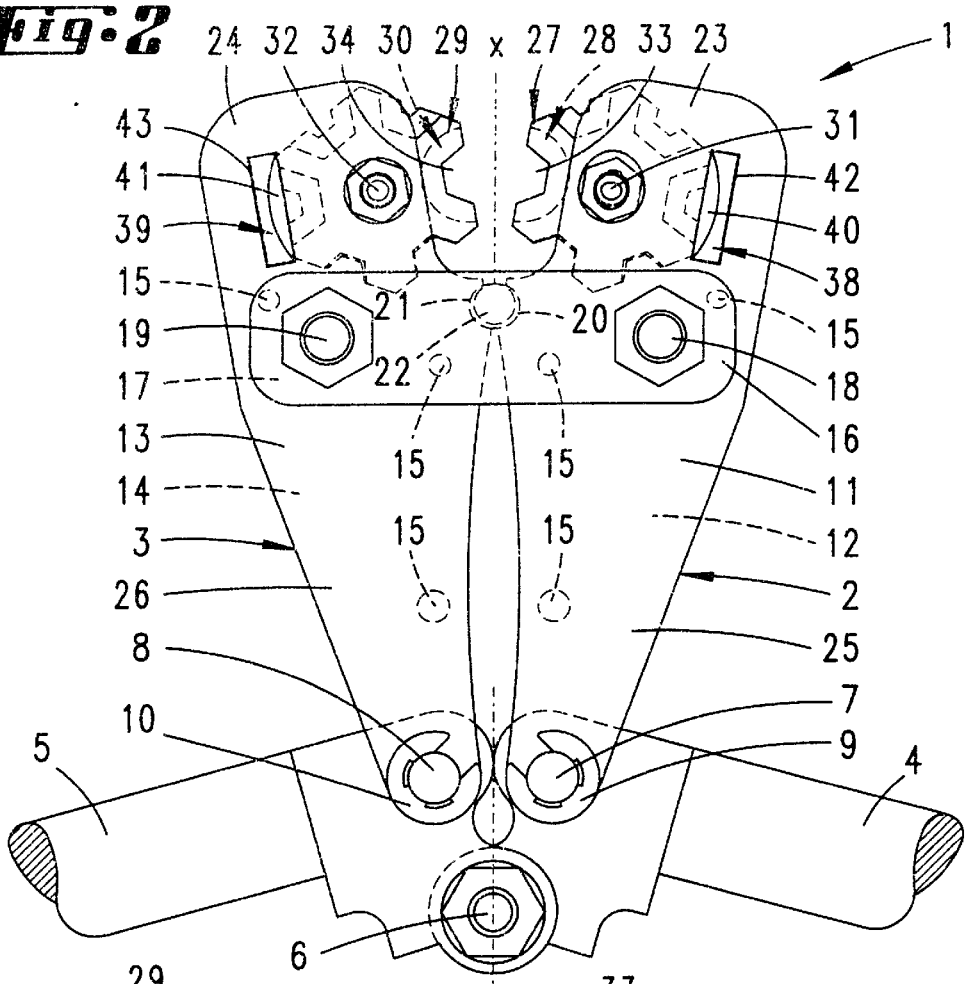
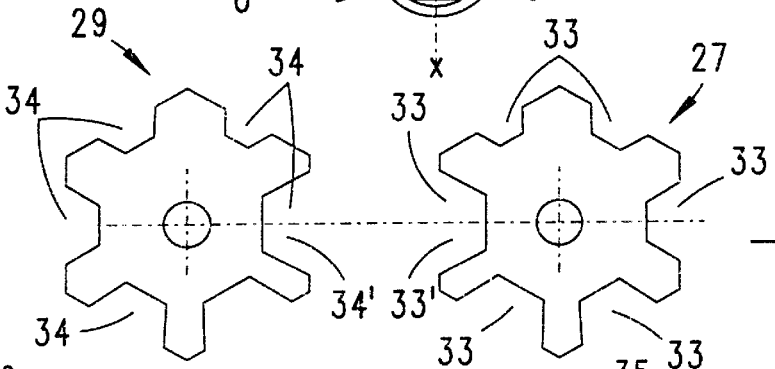
Fig. 3
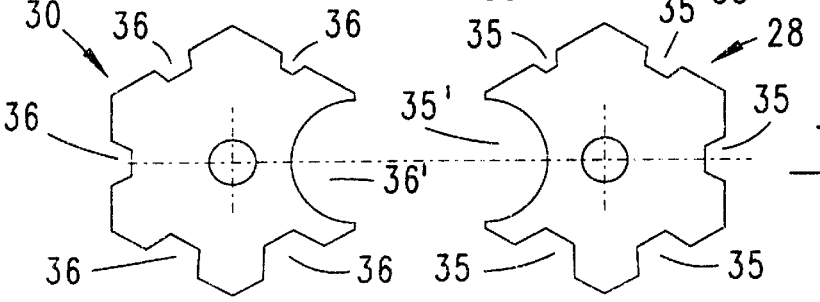
Fig. 4

VII
VII
VII
VII

PRESS TOOL

FIELD AND BACKGROUND OF THE INVENTION

The invention relates to a press tool for pressing cable terminals and connectors or the like onto electrical conductors, having two clamping jaws movable against one another, there being rotatably mounted in each clamping jaw, respectively one disc-type press die formed with several different press troughs on the circumference, which press die is lockable in each working position.

Press tools of this kind are known both as manually-operated tools and also as motor-operated tools. They are used, for example, to secure cable terminals to electrical conductors. For this purpose, the tubular workpiece is pressed together between two press jaws having, for example, openings of hexagonal cross-section. For each cable cross-section, there is required here, as a rule, a different press profile, that is to say an opening of different cross-section. Press tools are known, for example from U.S. Pat. No. 3,397,567, whose press jaws are moved by an electric motor towards one another, in which the tool change is effected by complete replacement of the inserts. This method shows itself disadvantageous to the effect that the loose, entrained inserts may easily be lost and, as a rule, fitting requires a further tool.

Other known tool-changing systems use a pair of rotatably mounted press dies in the form of profile wheels, which are connected in a non-demountable manner to the tool and have recesses of different press geometries distributed on the periphery. The maximum number of different sizes is limited by the allowable diameter of the profile disc. A press tool formed in such a manner is known, for example, from German Patent No. 28 41 588. The contents of that printed patent specification are incorporated in full in the disclosure of the present invention, also for the purpose of including features of that patent in claims of the present invention. In that printed patent specification, there is described a crimping tool for pressing cable terminals and connectors onto electrical conductors, in which crimping tool there is rotatably mounted, in each of the clamping jaws, a wheel-shaped press die formed as an even-sided polygon, which press die is provided on the periphery with several different press troughs. The press die is lockable in each working position by a spring-biased latch engaging on the periphery of the press die and displaceable parallel to the axis of rotation of the die, the latch engaging the side of the press die which is diametrically opposite the press trough in the respective working position.

SUMMARY OF THE INVENTION

Having regard to the above-described state of the art, a technical problem is to provide a press tool for pressing cable terminals and connectors or the like onto electrical conductors, which, for the same press die diameter, is characterised by a substantial increase in the number of different press geometries.

This problem is solved initially and substantially by the invention in that a second press die is associated with each press die, the second die being arranged to be rotatable independently of the first press die. By this arrangement, the number of different press geometries in a press tool of the kind in question is substantially increased in very simple manner. Each press die has a multiplicity of different press troughs formed on the periphery. In this connection, formation of the press dies in accordance with the previously described state of the art is preferred. Accordingly, there are provided press dies which, in plan view, define an even-sided polygon. Other shapes in plan view are however also to be envisaged. It is fundamental that press troughs of the one or the other press die are used depending on the geometry of the cable terminals or connectors to be pressed on. For this purpose, the selected press troughs are brought into a working position by the first press dies or the second press dies having the corresponding press troughs being rotated about a die axis. This position is lockable. Arrangements are to be envisaged in which there are provided, on the movable clamping jaws, respectively more than two press dies, positioned one after the other with reference to the axes of rotation of the dies. Preferred, however, is an arrangement in which each clamping jaw has two press dies. Then a first press die may be formed larger in diameter than the second press die, this with parallel and mutually offset disposition of the two axes of rotation of the dies. In a preferred embodiment of the subject of the invention, it is provided that the first press die and the second press die respectively are disposed coaxially. The result of this is that the two press dies have a common axis of die rotation. It is further proposed, for this purpose, that the diameter of the first die correspond to that of the second die. It proves to be substantially advantageous for, preferably, the two press dies to be formed identically as to area in plan view. With a formation in plan view in the manner of an even-sided polygon, there thus results the advantage according to the invention of almost a doubling of the number of press troughs.

In order to ensure an activation of the press troughs of the first die or of the second die, both press dies must each have one press trough, the cross-section of whose opening is greater than the cross-section of all of the openings of the other press die. For this purpose, it is proposed that the first press die or the second press die have a clearance trough, the cross-section of whose opening exceeds the cross-section of all other openings. This clearance trough is preferably not used as a press trough for the pressing-on of cable terminals or the like. The clearance trough serves only for activation of the press troughs of the other press die. All press troughs of the other press die may be used through this clearance trough. The further press troughs of the press die having the clearance trough have openings whose cross-sections are each smaller than the cross-section of the opening of the largest press trough of the other press die, by which means these smaller press troughs are usable through the largest press trough of the other press die. By this double-layered arrangement of the press dies, there is also further enabled a stepped crimping, in which, for example, a press trough of a first press die, formed larger in opening cross-section, is pressed onto the cable terminal or the like in an upper region with reference to the body axis of the cable terminal, and a press trough of the other press die, for example having an opening of a smaller cross-section, is correspondingly pressed onto the cable terminal in a lower region. In a stepped crimping thus to be envisaged, use may also be made of the aforementioned clearance trough of the one press die. This press die is formed, in a preferred embodiment, in such a way that the opening cross-section of the clearance trough is formed in the shape of a segment of a circle. Furthermore, in a press tool of the kind in question, in which locking of a press die may be effected by a bolt mounted substantially coaxially with the axis of rotation of the press die, it is provided that the bolt, in a first position, blocks the first press die and the second press die.

As already mentioned, a plan view in which the press dies define an even-sided polygon is preferred. In order to block the first press die and the second press die in the working position, the latch, which is formed as a slide, engages in each case against the side diametrically opposite the press trough of the one press die, which trough is pivoted into the working position, and against the side diametrically opposite the press or clearance trough of the other press die which provides clearance for the press trough of the one press die. Only one bolt is preferably used for each press-die assembly in one clamping jaw. This has the advantageous effect that in a working position of the press tool, only one bolt need be displaced into a locking position for the two press dies, which bolt is mounted on that clamping jaw coaxially with the axis of rotation of the press dies. This may be effected in very simple manner by thumb pressure, wherein furthermore this locking position may be, for example, latch-assisted. The width of the locking bolt is chosen to correspond approximately to a side length of the press dies, so that also in a working position in which the largest press trough is associated in deactivated manner with the bolt, there still remains a sufficiently large engagement surface between bolt and die. The bolt is furthermore advantageously formed so that the bolt, in a second position, releases the first press die or the second press die. Here, by a displacement of the bolt coaxially with the axis of rotation of the press dies, the bolt is displaced into a release position for the first press die or for the second press die. It is further provided that the bolt, in a third position, releases the second press die or the first press die. For example, the bolt may be formed in such a way that it has a central, rectangular cross-section with reference to the direction extending parallel to the axis of rotation of the press dies, and, above and below this central region, tapered cross-sections.

By displacement of the bolt out of the locking position, in which the preferably rectangular cross-section defines a bearing surface for a side face of the press dies, into a release position, there is provided the possibility of rotating the released press die in the region of the tapered cross-section of the bolt, for selection of a new press trough. There is preferred, in this connection, an arrangement in which only one press die of a clamping jaw is released by the displacement of the bolt, the locking of the other press die being maintained. This may be solved, for example, by the path of displacement out of a normal position defining the locking of the two press dies corresponding to the thickness of one press die, measured coaxially with the axis of rotation of the die. By this arrangement, there is avoided an unintentional, simultaneous rotation of the two press dies. In order to ensure a secure locking of the two press dies during the pressing operation, it is provided, in an advantageous further embodiment of the subject of the invention, that the bolt be spring-biased into the first position. There is thus no need, after rotation of the first released press die or of the second released press die, for manual displacement of the bolt into the first locking-defining position. This position, on the contrary, is found automatically under spring bias. The release of the first press die or of the second press die is therefore effected only by choice against a spring force. Finally, it is provided that the bolt has a recess which at least matches the peripheral rotational surface of the press die in a longitudinal portion corresponding to the second position or to the third position. This recess, ensuring the release of the first press die or of the second press die, is preferably formed curved, this segment of a circle having a diameter which corresponds at least to the diameter of the press dies. The above described embodiments according to the invention are usable both on manually-operated press tools and also on motor driven press tools.

BRIEF DESCRIPTION OF THE DRAWINGS

With the above and other objects and other advantages in view, the present invention will become more clearly understood in connection with the detailed description of a preferred embodiment, when considered with the accompanying drawings of which:

FIG. 2 shows a top view according to FIG. 1, but in an opened condition of the press tool;

FIG. 3 shows a detail representation of a first pair of press dies in top view;

FIG. 4 shows a detail representation of a second pair of press dies, likewise in top view;

DETAILED DESCRIPTION OF THE PREFERRED EMBODIMENTS

Figure 1:
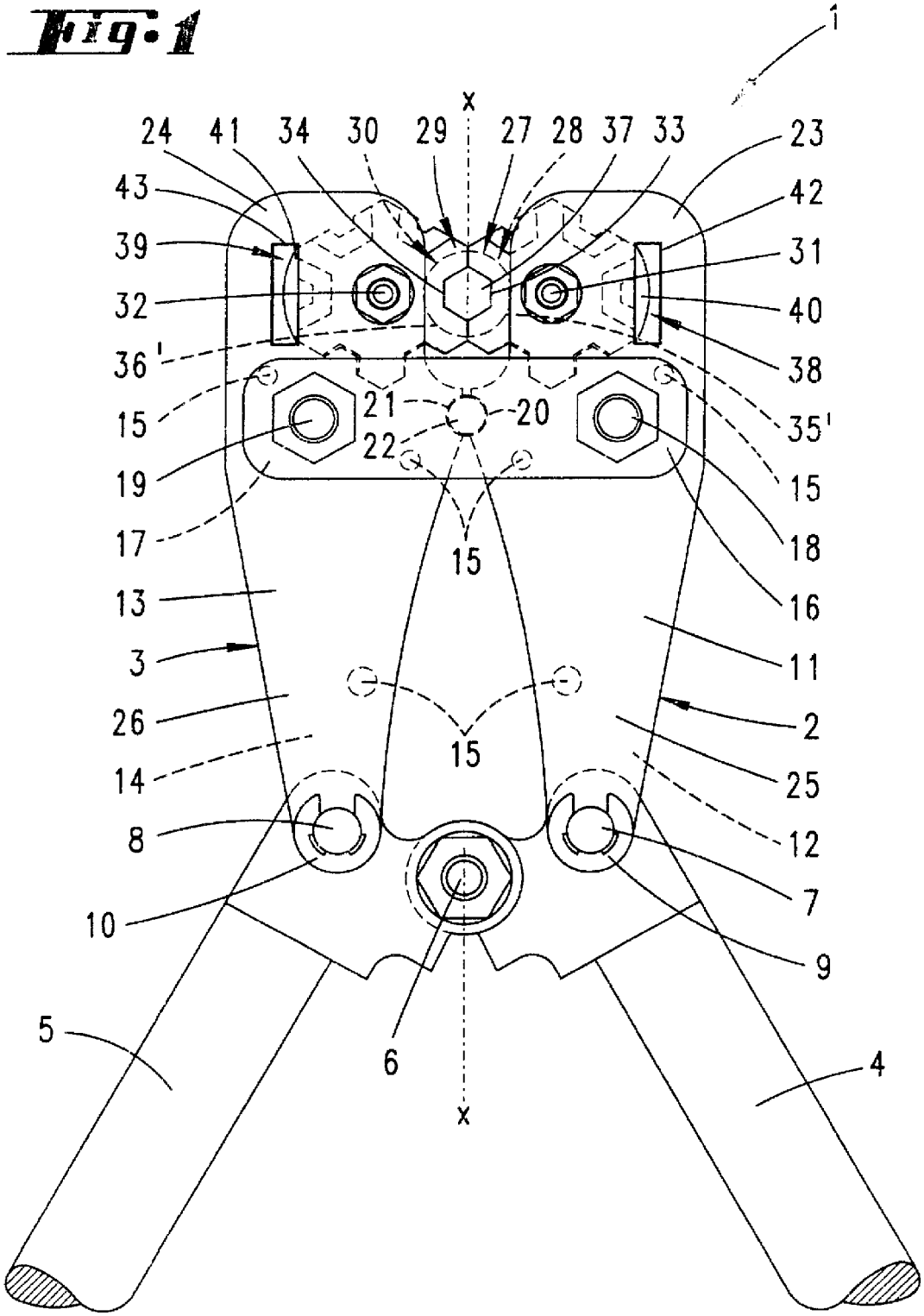
FIG. 1 shows in top view, a press tool according to the invention, formed as a hand tool, in a working position.

There is shown and described, initially with reference to FIG. 1, a manually-operated press tool 1 in a plan view showing a working position, that is to say a pressing position. The press tool 1 is constructed substantially symmetrically about an axis x—x and has two clamping jaws 2, 3 and two handles 4, 5, which handles are formed as bent levers. The handles are connected to one another at their angled ends by a pivot pin 6 disposed on the axis of symmetry x—x.

On either side of the pivot pin 6, the free end regions of the clamping jaws 2, 3 are linked to the handles 4, 5, there being provided bolts 7, 8 passing through the clamping jaws 2, 3 and the handles 4, 5, which bolts are secured by spring lock washers 9, 10. The clamping jaws 2, 3, which are similarly formed in mirror-image, each comprise two jaw plates 11, 12 and 13, 14, which are held at a spacing by distance pieces 15.

The clamping jaws 2, 3 are connected both on the upper side and also on the under side by straps 16, 17, which, in turn, are connected to one another by pivot pins 18, 19 passing through the clamping jaws 2, 3.

In the embodiment shown, there are formed, in the region of the straps 16, 17, on the mutually opposed narrow edges of the clamping jaws 2 and 3, trough-shaped recesses 20, 21, in which there is accommodated a cylindrical roller 22. The clamping jaws 2, 3 can slide on this roller on actuation of the handles 4, 5. In the axial direction, the roller is held between the straps 16 and 17. In order to approximate even better the symmetrical movement of the two clamping jaws 2 and 3, embodiments are also to be envisaged in which two cylindrical rollers are used.

The pivot axes for the clamping jaws 2, 3 are defined by the pivot pins 18, 19, by which the clamping jaws 2 and 3 are subdivided into short front lever arms 23, 24 and longer rear lever arms 25, 26.

In each of the front lever arms 23, 24 of the clamping jaws 2, 3, there are mounted a pair of press dies 27, 28 and 29, 30, rotatable on pins 31, 32. The pins 31 and 32 each pass through both plates of the clamping jaws 2, 3 and are secured on both sides, for example by means of screw threads.

The press dies 27 to 30 have the shape of an even-sided polygon in plan view. In the embodiment shown, the dies are formed as regular hexagons in plan view (see FIGS. 3 and 4). The press dies, which are in general formed to be disc-like, have on the periphery, press troughs 33, 34 and 35, 36 with openings of different cross-sections, each press trough being associated with a side face. In a plan view according to FIG. 3 and 4, the press troughs 33, 34 and 35, 36 have the shape of half of an even-sided hexagon. In the working position, that is to say in the pressing position according to FIG. 1, in each case two press troughs 33, 34 or 35, 36 having the same opening cross-section together form a regular hexagon 37 for pressing cable terminals, connectors or the like onto electrical conductors, etc.

As already indicated, there are provided in total four press dies 27 to 30, the dies 27 and 29 and the dies 28 and 30 lying opposite one another with respect to the axis of symmetry x—x, each pair of dies 27, 28 or 29, 30 associated with a clamping jaw 2 or 3 being disposed coaxially with one another. These two press dies associated with a clamping jaw are, accordingly, rotatable independently of one another on the common axis 31 and 32 respectively.

Figures 5, 6, 7, 8:
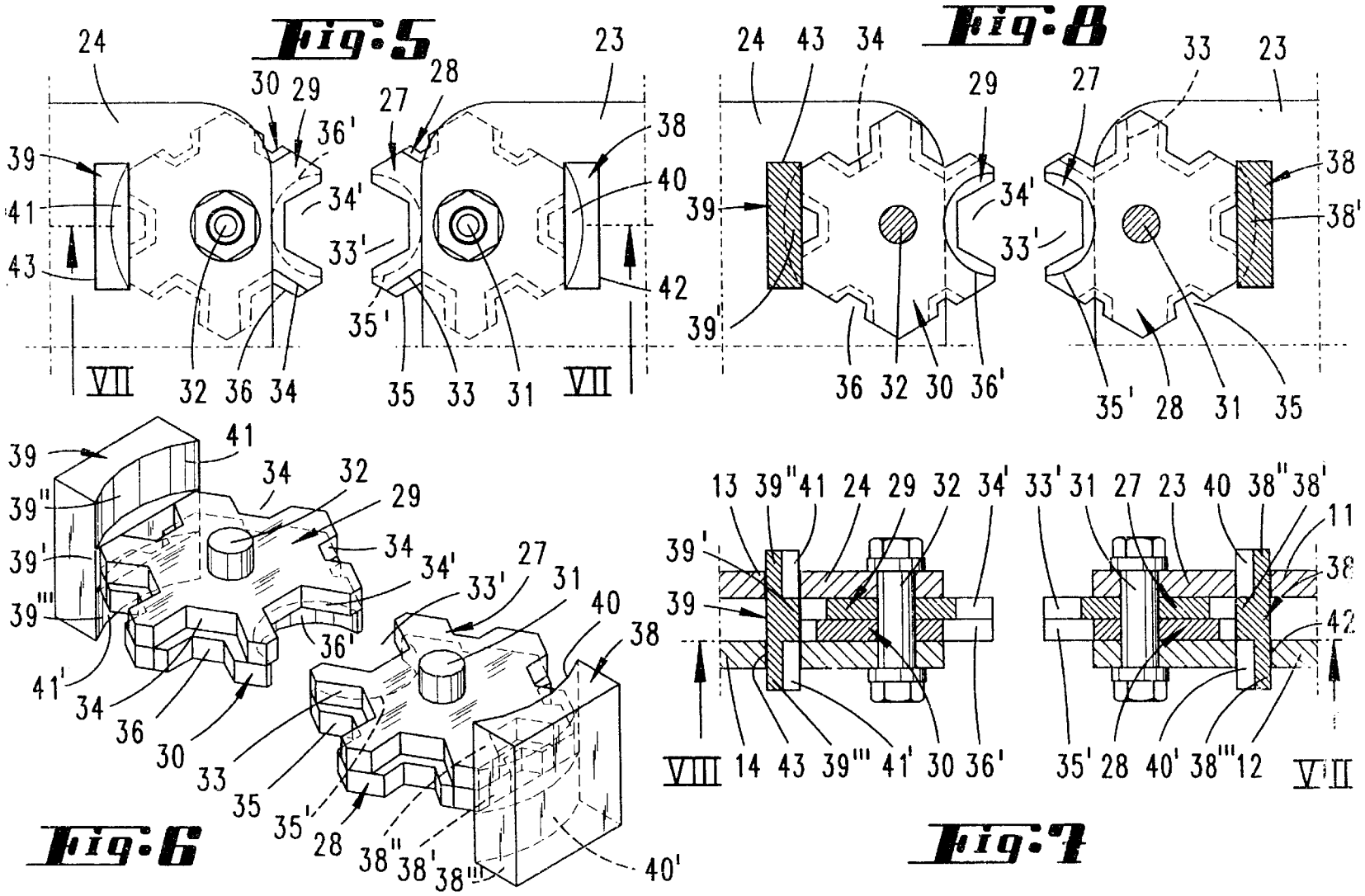
FIG. 5 shows in a top view, the region of the clamping jaws and press dies in an opened condition of the press tool.
FIG. 6 shows a perspective, diagrammatic detailed representation, relating to the press dies and bolts locking the dies, with omission of the clamping jaws, for the position according to FIG. 5.
FIG. 7 shows the section according to the line VII—VII in FIG. 5.
FIG. 8 shows the section according to the line VIII—VIII in FIG. 7.

Referring to FIGS. 6 and 7, the upper press dies 27 and 29 have the same diameter as the lower press dies 28 and 30, the upper press dies 27 and 29 each having, corresponding to their hexagonal shape in plan view, six press troughs 33, 34 with openings of different cross-sections. The lower dies 28 and 30, on the contrary, have only five press troughs 35, 36, whose opening cross-sections are likewise different, each opening cross-section, however, being smaller than the opening cross-section of the largest press trough 33', 34' of the upper press dies 27, 29. These largest press troughs 33', 34' of the upper press dies 27 and 29 allow the use of the lower press troughs 35, 36 which are smaller in opening cross-section.

For use of the upper press troughs 33, 34, the lower press dies 28, 30 are provided, in the region of the side faces unused in respect of press troughs, with clearance troughs 35' and 36' formed to be in the shape of a segment of a circle in plan view. The opening cross-section of these clearance troughs 35', 36' exceeds all other opening cross-sections, thus also those of the upper press dies 27, 29.

The press troughs 33', 34' and the clearance troughs 35', 36' allow, according to the invention, access to the press troughs formed in the other die, the press troughs 33', 34' opposite the clearance troughs 35', 36' serving likewise as clearance troughs to also allow use for pressing cable terminals or the like onto electrical conductors. In the embodiment shown, eleven usable profiles are accordingly available.

Alternatively, there remains the further possibility of providing two or more press troughs with smaller opening cross-sections beside one another in a side face, for example a side face of the lower press dies 28, 30, whereby the total number of profiles is further increased.

The press dies 27 to 30 are secured against unintentional rotation by slide members (bolts) 38, 39, which engage against a side face of the press dies in the region of the front lever arms 23, 24. The arrangement is such that in order to lock the press dies, the side faces of the dies engage against the bolts 38, 39 at locations diametrically opposite the side faces having the exposed press troughs, the width of a bolt 38, 39 being equal to or somewhat greater than the side length of the press die, so that also in regard to support of a side face having one of the largest press troughs, there still exists a sufficiently large bearing surface between bolt and die.

The bolts 38, 39 are displaceable coaxially with the rotational axes 31, 32 of the press dies, the bolts 38, 39 being held preferably spring-biased in a locking position (see FIGS. 5 to 8 in this connection) in a first position defining the normal position. The spring providing the bias is not shown in the drawings. Other locking possibilities are also to be envisaged to define the normal position, such as, for example, as a latch-type securing device or the like.

The bolts 38, 39 have a region 38', 39' of rectangular cross-section, which is central with respect to the longitudinal direction extending parallel to the axes 31, 32. This region is the locking region. The associated side faces of the two press dies engage, in the locking position according to FIGS. 5 to 8, against the side face of this rectangular portion.

On both sides of the central region 38' and 39', the bolts 38, 39 have longitudinal portions 38", 38"' and 39", 39"' respectively, in which regions there are formed recesses 40, 40' and 41, 41' respectively, which are in the shape of a segment of a circle in plan view. The recesses have a radius, with respect to the axes 31 and 32 respectively, which is dimensioned somewhat greater than the outer radius of each press die.

The bolts 38, 39 project on both sides beyond the jaw plates 11, 12 and 13, 14 respectively, for actuation, for example, by thumb pressure. For this purpose, there are left free, in the jaw plates, apertures 42, 43 corresponding to the substantially rectangular plan of the bolts 38, 39.

By axial displacement, for example of the bolt 38, parallel to the axis 31, a press die 27 or 28 is released. The maximum path of displacement of the bolt 38 is so dimensioned that only one press die, for example the press die 27, is released, the neighbouring press die, for example the press die 28, continuing to remain locked by the central, rectangular region 38'. By this, there is prevented an unintentional simultaneous rotation of the two press dies.

Figure 11:
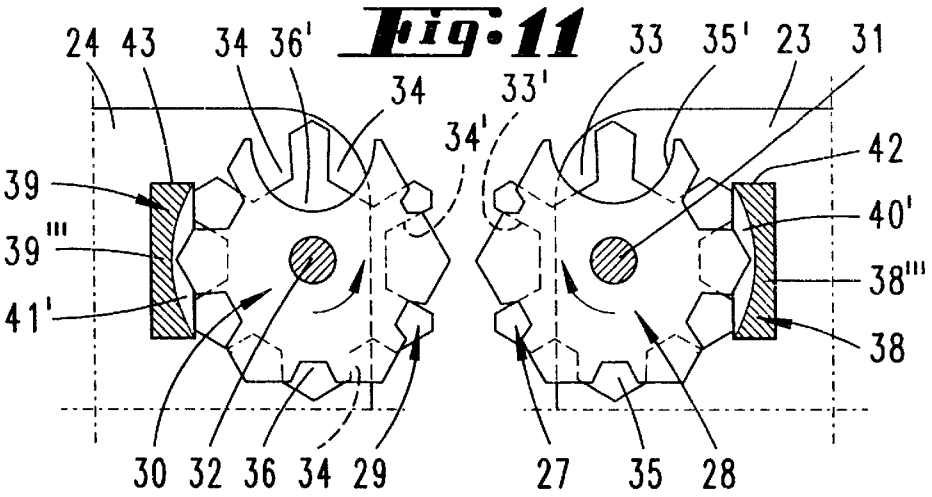
FIG. 11 shows the section according to the line XI—XI in FIG. 10.
Figure 10:
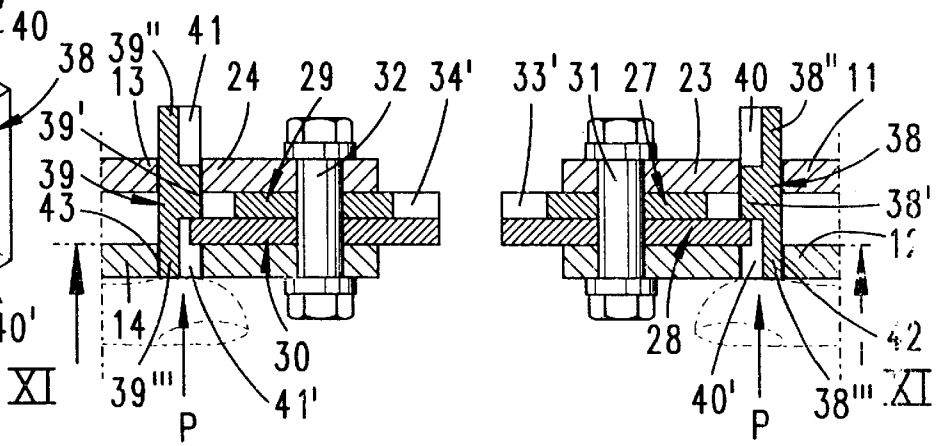
FIG. 10 shows a representation corresponding to FIG. 7, but for the position according to FIG. 9.
Figure 9:
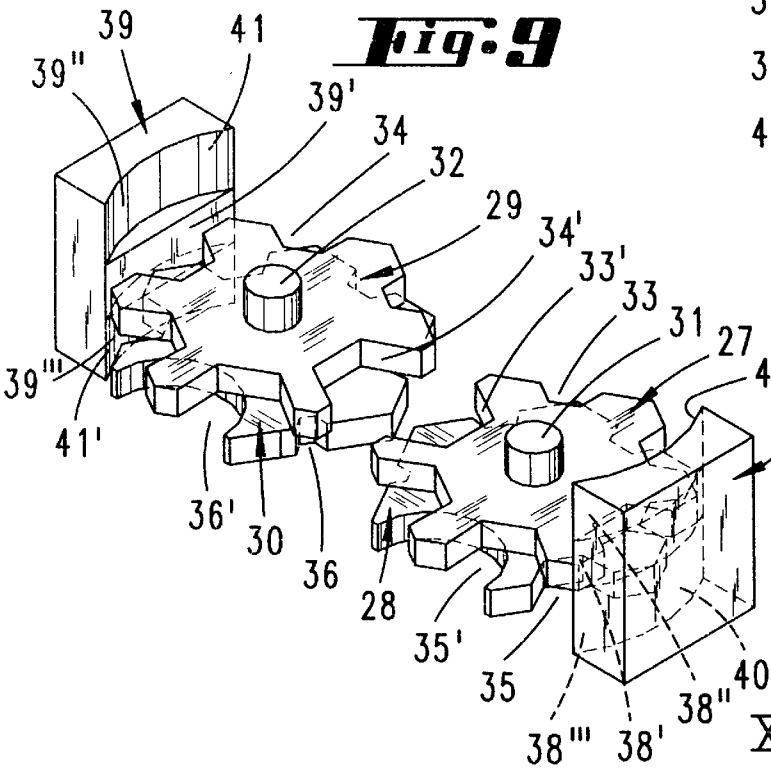
FIG. 9 shows a representation corresponding to FIG. 6, but after displacement of the bolts into a release position, two opposing, released press dies being partially rotated.

In FIGS. 9 to 11, there is shown a release position of the lower press dies 28 and 30. Here, the bolts 38 and 39 are displaced in the direction of the arrow P in such a way that the recesses 40' and 41' enter into the rotational region of the lower dies 28 and 30. There is thus enabled the rotation of the lower press dies 28 and 30, the upper press dies 27 and 29 remaining in engagement against the respective central regions 38' and 39' of the bolts 38 and 39 which have the rectangular cross-section. After reaching the desired position of the press dies which are to be rotated, the bolts 38, 39, by being released, are automatically displaced by the spring bias back into the locking position.

The end positions of the bolts 38, 39 for release of respectively the upper and lower die pairs are preferably stop-limited. This stop-limiting feature may, for example, be effected in very simple manner by the user himself, in that the cross-sectional area of the bolts 38, 39 is so dimensioned that the bolts cannot be pushed by finger pressure through the apertures 42, 43 guiding the bolts 38, 39. The finger displacing the bolt 38 or 39 thus forms the stop limit (see FIG. 10).

According to the invention, each press die has associated with it a second press die arranged to rotate independently of the first press die. Alternatively to the embodiment shown, the axis of rotation of the second press die may be disposed offset in plan view from the first press die, it being essential, however, that the press troughs of the second press die may be pivoted into the region of the largest press trough of the first press die, and the second press die having a clearance trough whose opening cross-section exceeds all other opening cross-sections, in particular of the first press die.

The embodiments shown and described are usable, in addition, both on shears-type parts and also on parts to be moved in a straight line against one another, such as for example clamping jaws of a motor-operated tool.

By the above described embodiments, there is formed a tool changing device for press tools which uses several pairs of press dies disposed beside one another in axial direction. By this arrangement, the number of different press geometries is substantially increased, for the same profile disc diameter. The provision of three or more press dies per clamping jaw is thus further to be envisaged.

I claim:

1. A press tool for pressing cable terminals and connectors onto electrical conductors, having two clamping jaws movable against one another to effect a pressing operation, there being rotatably mounted in each clamping jaw, respectively one disc-type press die formed with several different press troughs on the circumference, each press trough being selectable by rotation of the disc-type press die into a working position to operate on a cable terminal or connector, which press die is lockable in each working position, wherein a second press die is associated with each press die, the second press die being arranged to be rotatable independently of the first press die.

2. A press tool according to claim 1, characterized in that the first press die and the second press die are in each case arranged coaxially.

3. A press tool according to claim 1, characterized in that the diameter of the first press die corresponds to that of the second press die.

4. A press tool according to claim 1, characterized in that the first press die or the second press die has a clearance trough, the cross-section of whose opening exceeds the cross-section of the openings of all other troughs.

5. A press tool according to claim 4, characterized in that the opening cross-section of the clearance trough is formed in the shaped of a segment of a circle.

6. A press tool according to claim 1, in which locking of a press die is executable by a bolt mounted substantially parallel with the axis of rotation of the press die, characterized in that the bolt, in a first position, blocks the first press die and the second press die.

7. A press tool according to claim 6, characterized in that the bolt, in a second position, releases the first press die or the second press die.

8. A press tool according to claim 7, characterized in that the bolt, in a third position, releases the second press die or the first press die.

9. A press tool according to claim 6, characterized in that the bolt is spring-biased into the first position.

10. A press tool according to claim 8, characterized in that the bolt has a recess in a longitudinal portion corresponding to the second position or to the third position, which recess at least matches the peripheral surface of rotation of the press die.

* * * * *